US005662750A

United States Patent [19]

Shen

[11] Patent Number: 5,662,750

[45] Date of Patent: Sep. 2, 1997

[54] METHOD OF MANUFACTURING ALUMINUM ARTICLES HAVING IMPROVED BAKE HARDENABILITY

[75] Inventor: Tien H. Shen, Pleasanton, Calif.

[73] Assignee: Kaiser Aluminum & Chemical Corporation, Pleasanton, Calif.

[21] Appl. No.: 452,815

[22] Filed: May 30, 1995

[51] Int. Cl.[6] ..... C22F 1/043

[52] U.S. Cl. ..... 148/690; 148/693; 148/694; 148/700

[58] Field of Search ..... 148/690, 693, 148/694, 700, 702, 415, 417, 439, 440; 420/534, 544, 545, 546, 553

[56] References Cited

U.S. PATENT DOCUMENTS

| | | | |
|---|---|---|---|
| 4,718,948 | 1/1988 | Komatsubara et al. | 148/439 |
| 4,784,921 | 11/1988 | Hyland et al. | 148/439 |
| 4,808,247 | 2/1989 | Komatsubara et al. | 148/693 |
| 4,897,124 | 1/1990 | Matsuo et al. | 148/440 |
| 5,266,130 | 11/1993 | Uchida et al. | 148/552 |

*Primary Examiner*—George Wyszomierski

*Attorney, Agent, or Firm*—Gerald D. Haynes; Philip L. McGarrigle

[57] ABSTRACT

A method of producing an aluminum article comprising the steps of: (a) providing stock including an aluminum alloy comprising about 1.0 to 1.3 wt.% silicon, about 0.40 to 0.80 wt.% magnesium, about 0.02 to 0.20 wt.% of an element selected from the group consisting of manganese and chromium, not more than about 0.70 wt.% copper, the remainder substantially aluminum, incidental elements and impurities; (b) hot rolling the stock at a temperature ranging from about 980° to 1025° F. to obtain a gauge thickness ranging from about 0.20 to 0.10 inches; (c) solution heat treating at a temperature ranging from about 1000° to 1030° F. for a time period of about 3 to 10 minutes; (d) rapid quenching at a rate of about 500° F./second to a threshold temperature of about 200° F. for a time period ranging from about 2 to 10 minutes; (e) cooling to room temperature at a rate above 1.8° F./second; (f) holding at room temperature for not more than 6 hours; and (g) reheating to a temperature of about 200° F. for a time period of about an hour.

16 Claims, 4 Drawing Sheets

METHOD OF MANUFACTURING ALUMINUM ARTICLES HAVING IMPROVED BAKE HARDENABILITY

BACKGROUND OF THE INVENTION

1. Field of the Invention

The present invention relates to the manufacture of an aluminum alloy article exhibiting improved bake hardenability. More particularly, the present invention relates to an aluminum alloy product of the Aluminum Association ("AA") 6000 aluminum alloy series exhibiting improved paint bake response when utilized for automotive purposes, such as vehicular panels.

2. Description of the Related Art

Workers in the field commonly employ aluminum alloy sheet products, such as vehicular panels, during the manufacture of automobiles. They prefer aluminum panels because of their light weight. In addition to being light weight, it is important that the vehicular panels have good strength properties as well as exhibiting good formability at room temperature. Thus, for many years, workers in the field made serious attempts to manufacture aluminum alloy products for the automotive industry which satisfy both of these requirements. For example, U.S. Pat. No. 4,784,921, to Hyland et al., describes an aluminum alloy automotive material of the AA 2000 alloy series having improved strength and formability properties. This reference teaches that the improved properties are obtained by solution heat treating at temperatures between 900° and 1100° F. to produce a structure of fine grain size, followed by rapid quenching of the product from the solution heat treatment temperature to 350° F. or lower at a rate of at least 10° F./sec., preferably at least 300° F./sec. Cooling from 350° F. to room temperature is accomplished at a relatively low quench rate, using air as the quenching medium. The quenched product is then aged to obtain a substantially stable level of mechanical properties. The automotive material so prepared is shown to exhibit stable strength for many months while exhibiting good formability.

Alloys of the Aluminum Association ("AA") 6000 series present an additional problem. The natural aging of AA 6000 series alloys at room temperature is detrimental to the artificial aging process. The clusters formed during natural aging are too small. Although these small clusters grow larger during prolonged room temperature aging, they still fail to achieve the critical size that is necessary to be stable at the subsequent artificial aging temperature. Furthermore, the growth of these dusters during natural aging also depletes the supersaturation of solutes in the matrix. These two mechanisms hinder the precipitation of $Mg_2Si$ during the artificial aging. As a consequence, artificial aging response is reduced by prolonged room temperature aging resulting in diminished mechanical properties of the AA 6000 alloy after artificial aging.

Ideally, after forming, the sheet would receive a separate aging treatment to increase its strength to the maximum possible for the particular AA 6000 series alloy. The economies of automobile production, however, require that the metal strength be increased by the baking used to harden the paint on the partially assembled vehicle. Unfortunately, the paint baking temperatures are lower than the optimum, and it is necessary to modify the sheet properties to increase strength levels achieved in the paint bake.

Workers in the field have made several attempts to process AA 6000 series alloys having improved bake hardenability or paint bake response. For example, U.S. Pat. No. 4,718, 948, to Komatsubara et al., describes a rolled aluminum alloy sheet of good formability for automotive purposes. The sheet products made from a AA 6000 series aluminum alloy containing a relatively high quantity of silicon, from 1.25 to 2.5 wt.%. The sheet product is first subjected to a solution heat treatment at about 1000° F. and then quenched to room temperature at the rate of about 1800° F./min. The quenched sheets are then aged at room temperature for about two weeks and the aged sheet products are claimed to have improved mechanical and forming properties, particularly improved baize hardenability.

Similarly, U.S. Pat. No. 4,808,247, also to Komatsubara et al., describes a AA 6000 series aluminum alloy rolled sheet of improved formability and yield strength. These improved properties can, according to the reference, be obtained by solution heat treating the sheet made from the aluminum alloy for at least 5 seconds at temperatures between 500°–580° C., followed by rapid quenching to room temperature at a rate within the range of 5°–300° C./sec. If good sheet flatness is not a consideration and only high strength is desired quenching rates in excess of 300° C./sec. are recommended by the patent.

Likewise, U.S. Pat. No. 4,897,124, to Matsuo et al., concerns a AA 6000 series (Aluminum-Silicon-Magnesium) aluminum alloy rolled sheet exhibiting improved properties, such as good formability, elongation, high strength and corrosion-resistance. When the aluminum alloy sheet of this reference is utilized for automotive body sheets, such body sheets possess improved post-bake strength. To obtain these improved properties the rolled sheet is subjected to a solution heat treatment at 450°–590° C., followed by rapid quenching to room temperature at a rate of not less than 5° C./sec.

In general, the above references describe solution heat treatment followed by a rapid quench to room temperature to obtain improved paint bake response. In U.S. Pat. No. 5,266,130, to Uchida et al., a two-stage quenching process is used to produce a AA 6000 series rolled aluminum alloy sheet having improved shape fixability and bake hardenability. Specifically, these improved properties are obtained by solution heat treatment of the rolled sheet at 450°–580° C., followed by a two-stage quenching process. In the first stage of the quenching process, the solution heat treated sheet is cooled to a temperature within 60°–250° C. at a rate of 200° C./min. or more, followed by a second stage cooling to a final temperature of 50° C. at a significantly lower cooling rate. The reference teaches that the cooling rate of the second stage quench must be done at a slow rate to prevent the formation of GP zones which result in poor bake hardenability. The main drawback of this reference is that the sheet cannot be allowed to cool below 50° C. (122° F.). Cooling below 122° F. would probably result in the formation of GP zones and poor bake hardenability. This is a serious practical limitation because the operation of commercial plants require that sheet material be held for several hours at room temperature before it can be further processed.

In general, aluminum sheet is processed as coils and involves many steps, including hot rolling, cold rolling, trimming, annealing, heat treating, quenching, and leveling. For economical processing, it is fed from process to process as strip in a continuous manner. The continuous nature of the process puts constraints on the individual processes which must be adjusted to fit the speed of the strip, which in turn is strongly governed by the economics of the total process.

Although the overall processing is constrained by the speed of the strip, the individual steps of the process can be controlled in a number of ways, including by adjusting the temperature, and by choosing the length of the path through the process equipment, which in fact controls the time in which the aluminum is in the individual process.

The time in each process is, however, limited by certain practicalities such as the necessity to use existing equipment, and limitations on the length of the process equipment. Thus, a need remains for a process which uses existing heat treating equipment without forcing the production line to be operated at non-economically slow speeds. A solution to these limitations can be to remove the aluminum alloy from the continuous process and perform a batch process. Batch processing of the aluminum sheet would, however, require that the sheet be held or stored, generally at room temperature, for several hours or even up to a day before it can be further processed.

Thus, a need remains for a method of producing AA 6000 series aluminum alloy rolled sheet that exhibits improved formability and improved strength after low temperature aging as caused by the paint baking step used in the curing of paint on new automobiles and yet can be stored at room temperature for up to a day before further processing without having significantly diminished physical properties after the paint bake step. Accordingly, it is an object of this invention to provide such a method.

SUMMARY OF THE INVENTION

The present invention provides a method of producing an aluminum article comprising the steps of: (a) providing stock including an aluminum alloy comprising about 0.40 to 1.50 wt.% silicon, about 0.20 to 1.50 wt.% magnesium, not more than about 1.20 wt.% copper, about 0.02 to 0.20 wt.% of an element selected from the group consisting of manganese and chromium, the remainder substantially aluminum, incidental elements and impurities; (b) hot working the stock; (c) solution heat treating at a temperature ranging from about 900° to 1100° F. for a time period of about 2.0 seconds to about 30 minutes; (d) rapid quenching at a rate of at least about 200° F./second from the solution temperature to a temperature of 350° F. or lower for a time period of at least 30 seconds; (e) cooling to room temperature; (f) holding at room temperature for not more than 24 hours; and (g) reheating to a temperature ranging from about 150° to 360° F. for a time period of about 24 hours to 2.0 minutes.

The foregoing and other objects, features, and advantages of the invention will become more readily apparent from the following detailed description of preferred embodiment which proceeds with reference to the drawings.

DETAILED DESCRIPTION OF THE PREFERRED EMBODIMENT

Figure 1:
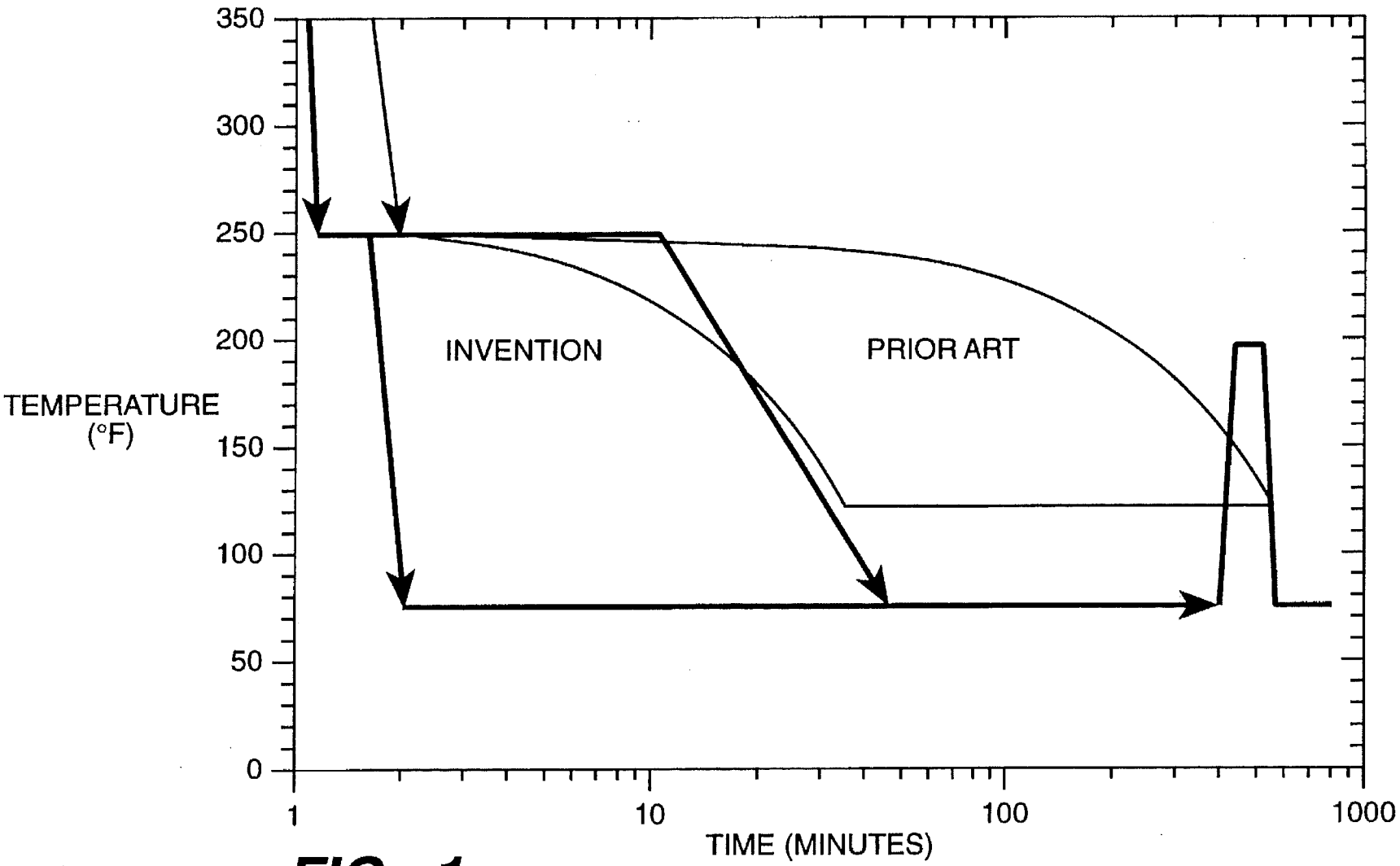
FIG. 1 shows a controlled heat pattern of cooling after solution heat treatment at a threshold cooling temperature of 250° F. according to the present invention compared to the prior art.

This invention relates to AA 6000 series rolled aluminum alloy sheet products exhibiting significantly improved forming characteristics and post-bake strength. More particularly, this invention concerns the production of an improved Aluminum-Silicon-Magnesium alloy rolled sheet product for use in the automotive industry where products exhibiting ready formability and high strength are required. The process involves providing stock comprising an aluminum alloy including about 0.40 to 1.50 wt.% silicon, about 0.20 to 1.50 wt.% magnesium, about 0.02 to 0.20 wt.% of either manganese or chromium, about 0.20 to 1.20 wt.% copper, the remainder substantially aluminum, incidental elements and impurities; hot working the stock; solution heat treating at a temperature ranging from about 900° to 1100° F. for a time period of about 2.0 seconds to about 30 minutes; rapid quenching at a rate of at least about 200° F./sec. to a threshold temperature ranging from about 150° to 250° F.; cooling at room temperature for not more than 24 hours; and reheating to a temperature ranging from about 150° to 360° F. for a time period of about 24 hours to two minutes. The higher the reheat temperature the less amount of time is required to obtain the beneficial result.

The chemical composition of the alloy of the present invention is similar to that of AA 6000 series alloys. A preferred alloy would comprise about 1.0 to 1.3 wt.% silicon, about 0.40 to 0.80 wt.% magnesium, not more than about 0.70 wt.% copper, about 0.02 to 0.20 wt.% of either manganese or chromium, the remainder substantially aluminum, incidental elements and impurities.

Hot Working Step

Initially, I hot work the stock. Depending on the type of product I wish to produce, I either hot roll, extrude, forge or use some other similar hot working step. My new process is well-suited for matting automobile body sheet, so I prefer a hot rolling step where the stock is heated to a temperature ranging from about 800° to 1100° F. for about 1 to 24 hours. Most preferably, I heat the stock to a temperature ranging from about 980° to 1025° F. for about 1 to 6 hours to obtain a gage thickness ranging from about 0.02 to 0.10 inches. I generally perform hot rolling at a starting temperature ranging from about 800° to 1000° F., or even higher as long as no melting or other ingot damage occurs.

Optionally, before the hot working step, I homogenize the stock to produce a substantially uniform distribution of alloying elements. In general, I homogenize by heating the stock to a temperature ranging from about 800° to 1100° F. for a period of at least 1 hour to dissolve soluble elements and to homogenize the internal structure of the metal. Preferably, I homogenize for about 4 to 6 hours at about 1025° F.

Cold Working Step

Depending on the type of sheet that I am producing, I may additionally cold working after hot rolling to further reduce sheet thickness. Preferably, I allow the sheet to cool to less than 100° F. and most preferably to room temperature before I begin cold rolling. Preferably, I cold roll to obtain at least a 40% reduction in sheet thickness, most preferably I cold roll to a thickness ranging from about 50 to 70% of the hot rolled gauge. In an alternative embodiment, the process of my invention can be practiced by providing the AA 6000 series alloy as discussed above and then strip-casting and cold rolling the stock instead of hot working.

Solution Heat Treating Step

After cold rolling (or after hot rolling if I do not cold roll) I next solution heat treat the stock. Generally, I solution heat treat at a temperature ranging from about 900° to 1100° F. for about 2 seconds to 30 minutes. It is important to rapidly heat the stock, preferably at a heating rate of about 100° to 2000° F./min. Preferably, I solution heat treat a temperature ranging from about 1000° to 1030° F. for a time period ranging from about 3 to 10 minutes. Most preferably, I solution heat treat at about 1015° F. for about 10 minutes at a heating rate of about 1000° F./min.

Rapid Quenching Step

After solution heat treatment, I rapidly cool the stock to minimize uncontrolled precipitation of secondary phases such as $Mg_2Si$. Generally, I quench at a rate of at least 200° F./sec. from the solution temperature to a temperature of 350° F. or lower. Preferably, I quench at a rate of at least 300° F./sec. to the temperature range of about 190° to 210° F. Most preferably, I quench using a high pressure water spray or by immersion into a water bath, generally at a quench rate of at least 500° F./second to a temperature of about 200° F. I generally hold the stock at the cooled temperature for about at least 30 seconds, preferably from about 1 minute to 1 hour and most preferably from about 2 to 10 minutes.

By rapidly quenching at at least 200° F./sec., I avoid the intergranular corrosion susceptibility which is caused by precipitation at the grain boundaries. Importantly, this allows me to cool and store the heat treated sheet at temperature below 120° F. without forming GP zones which are deleterious to subsequent artificial aging.

Holding at Room Temperature

After the rapid quenching step, I next allow the article to cool naturally in air to room temperature. Generally, I allow the stock to air cool to room temperature at a rate above 1.8° F./second. I can then hold the stock at room temperature up to 24 hours, preferably however, it is better to hold the stock at room temperature for less than 6 hours. The availability of this holding period or delay time is an important advantage of my invention.

The commercial manufacturing of aluminum sheet involves many process steps such as hot and cold rolling, heat treating, annealing and so on. Preferably, the sheet is fed as a strip from process to process in a continuous manner. The entire process must then, however, be slowed to accommodate the slowest process step. Alternatively, some of the slower steps can be performed as a batch process thus allowing the remaining continuous process steps to operate more efficiently at higher speeds. Batch processing necessarily requires that the sheet be held or stored, generally at room temperature, for several hours or even a full day while awaiting to be batch processed. In addition, the aluminum sheet may be stored at room temperature immediately after batch processing while waiting to be further processed in the continuous process. My invention allows for the flexibility of a holding period in which the sheet can be stored at room temperature without resulting in a significant deterioration in metallurgical properties.

Pre-Aging Step

After the holding period, I then pre-age by reheating the sheet to a temperature ranging from about 150° to 360° F. for a time period ranging from about 24 hours to 2 minutes. The higher the temperature, the less required time necessary to obtain the desired pre-aging. Preferably, I reheat to a temperature ranging from about 190° to 210° F. for about 1.5 to 0.5 hours, most preferably I reheat to about 200° F. and hold it there for about 1 hour.

Controlled Heat Patterns

Figure 2:
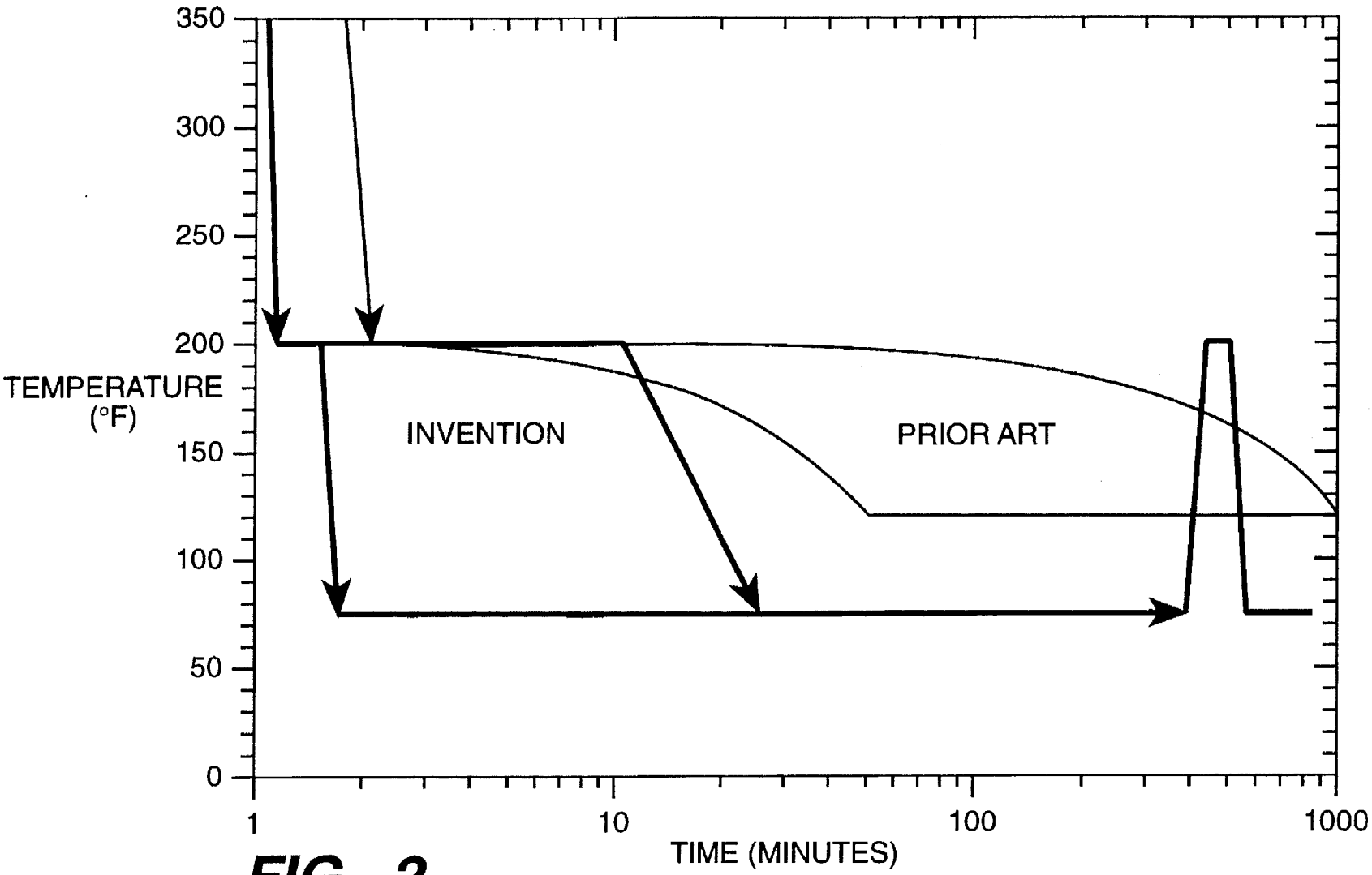
FIG. 2 shows a controlled heat pattern of cooling after solution heat treatment at a threshold cooling temperature of 200° F. according to the present invention compared to the prior art.
Figure 3:
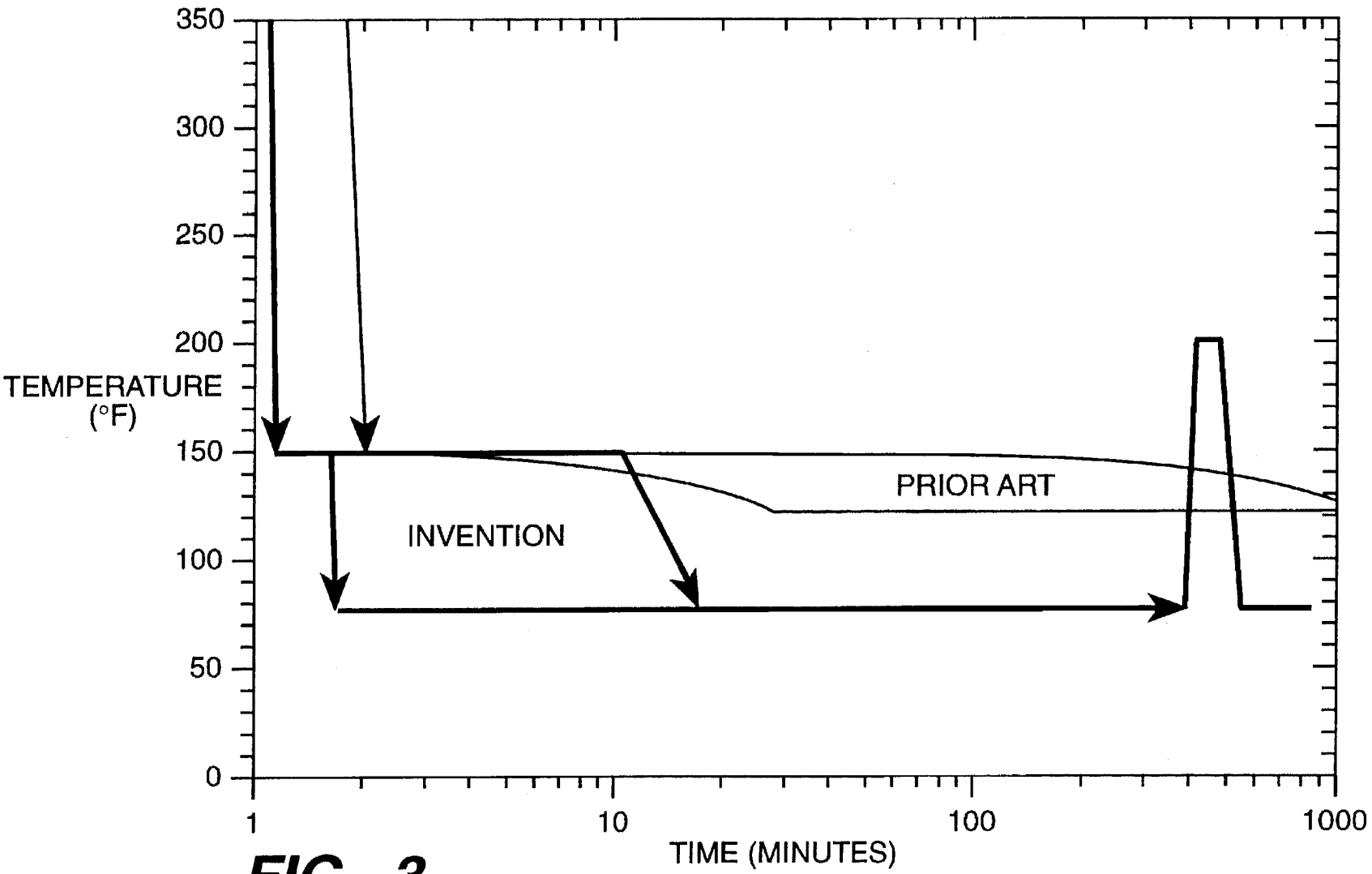
FIG. 3 shows a controlled heat pattern of cooling after solution heat treatment at a threshold cooling temperature of 150° F. according to the present invention compared to the prior art.

Referring now to FIGS. 1, 2, and 3, I now illustrate three embodiments of my invention as compared to the prior art. The prior art is generally represented by U.S. Pat. No. 5,266,130 to Uchida et al. FIGS. 1, 2, and 3 compare my invention to the teachings of Uchida et al. at threshold cooling temperatures of 250° F., 200° F., and 150° F., respectively. FIGS. 1, 2, and 3 illustrate an important advantage of my invention: the ability to store heat treated sheet at a temperature below 122° F. (50° C.) for up to 24 hours without degrading the strength properties of the sheet.

EXAMPLE

To demonstrate the present invention, I first prepared an alloy as direct chill cast ingot having the following composition:

| Element | Wt. % |
|---|---|
| Si | 1.26 |
| Mg | 0.79 |
| Cu | 0.71 |
| Fe | 0.13 |
| Cr | 0.049 |

I preheated the ingot to 1025° F. for four hours, followed by an air cool. I then scalped 0.25" from the top and bottom rolling surfaces. Next, I reheated it to 950° F. for an hour, hot rolled it to a gauge of 0.125". After hot rolling, I annealed the strip at 650° F. for 2 hours and then cold rolled to a final gauge of 0.04". I then solution heat treated samples for 15 minutes at 1015° F., quenched them in 200° F. water for 3 minutes. After the quench, I then allowed the samples to cool to room temperature and held them at room temperature for time periods ranging from 1 to 24 hours, before I then artificially aged them by reheating to 200° F. for an hour. After the two-step aging, I naturally aged the samples for 11 days before conducting two simulated paint bakes: one at 302° F. for 20 minutes and the other at 356° F. for 45 minutes.

Table 1 summarizes the effect of the delay time during the two-step aging on paint bake response as measured by the yield strength after the two simulated paint bake conditions.

TABLE 1

| | YIELD STRENGTH (ksi) | | | | | | |
|---|---|---|---|---|---|---|---|
| | | | Two-Step Aging Delay Before Second Aging | | | | |
| Simulated Paint Bake | 70° F. W.Q. | No Two-Step Aging | No Delay | 1 hr. | 3 hr. | 6 hr. | 24 hr. |
| 302° F./20 min. | 25.0 | 25.2 | 27.1 | 26.4 | 27.0 | 26.7 | 25.6 |
| 356° F./45 min. | 32.9 | 35.9 | 38.6 | 39.0 | 38.7 | 38.4 | 36.2 |

Figure 4:
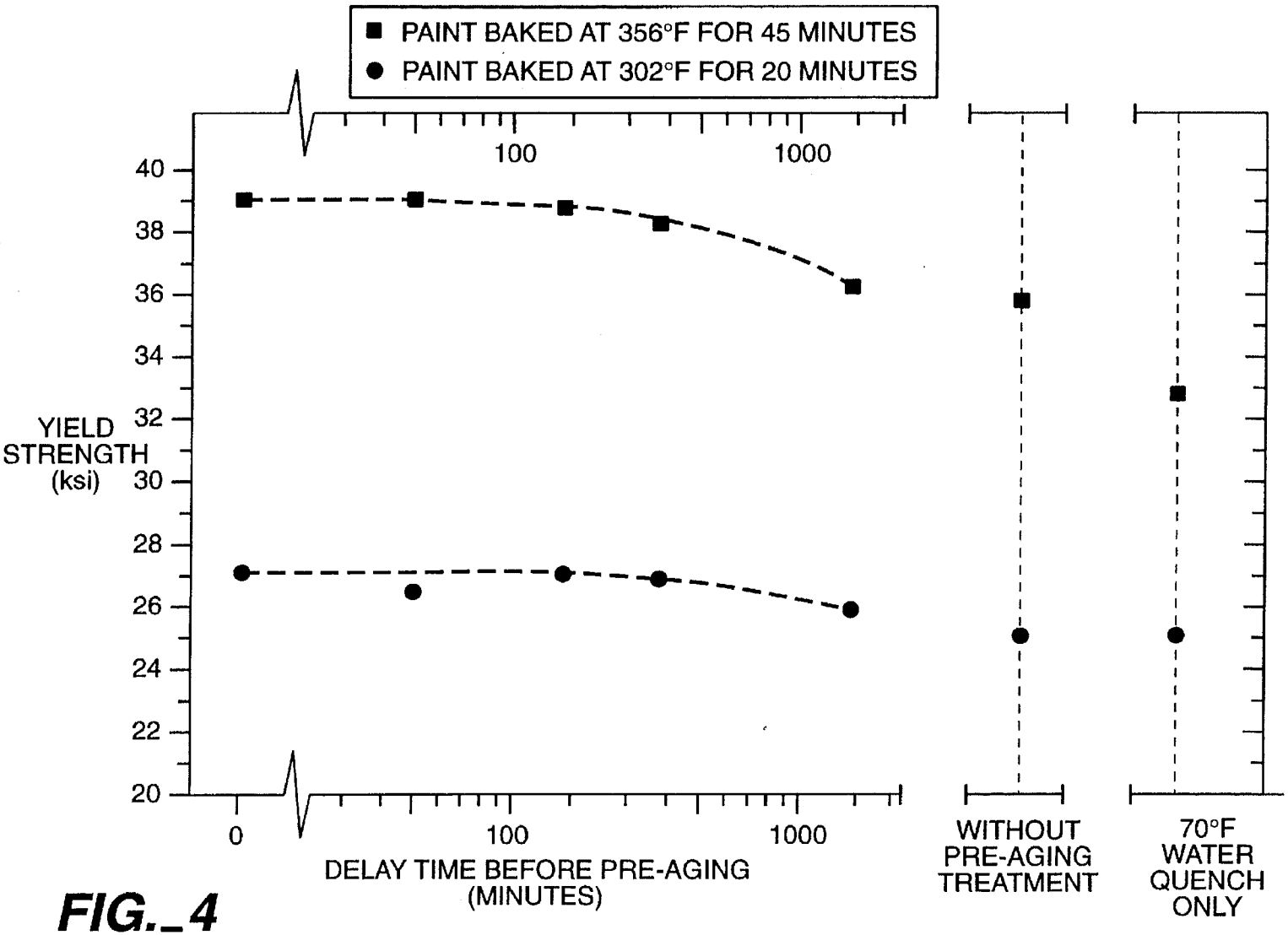
FIG. 4 is a graph showing yield strength as a function of delay time between quench and pre-aging according to the present invention.

FIG. 4 shows the effect of delay time on paint bake response. For a delay time as long as 6 hours after the 200° F. quench, no significant deterioration in paint bake response was observed. For samples that were delayed for 24 hours, the paint bake response dropped to a level similar to that of samples that received only a 3 minute, 200° F. water quench. The paint bake response after 11 days of natural aging, however, was still better for the 3 minute, 200° F. water quenched sample than that of the 70° F. water quenched sample.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A method of producing an aluminum article comprising the steps of:

(a) providing stock including an aluminum alloy comprising about 0.40 to 1.50 wt.% silicon, about 0.20 to 1.50 wt.% magnesium, not more than about 0.70 wt.% copper, about 0.2 to 0.20 wt.% of an element selected from the group consisting of manganese and chromium, the remainder substantially aluminum, incidental elements and impurities;

(b) hot working the stock;

(c) solution heat treating at a temperature ranging from about 900° to 1100° F. for a time period of about 2.0 seconds to about 30 minutes;

(d) rapid quenching at a rate of at least about 200° F./second from the solution temperature to a threshold temperature of 350° F. or lower;

(e) holding at the threshold temperature for a time period of at least 30 seconds;.

(f) cooling from the threshold temperature to room temperature;

(g) holding at room temperature for not more than 24 hours; and (h) reheating to a temperature ranging from about 150° to 360° F. for a time period of about 24 hours to 2.0 minutes.

2. The method of claim 1 wherein step (b) is selected from the group consisting of, hot rolling, extruding, and forging.

3. The method of claim 1 wherein step (c) comprises solution heat treating at a temperature ranging from about 1000° to 1030° F. for a time period ranging from about 3 to 10 minutes.

4. The method of claim 1 wherein step (d) comprises rapid quenching at a rate of at least 300° F. per second to a threshold temperature ranging from about 190° to 210° F.

5. The method of claim 4 further comprising holding at the threshold temperature for a time period ranging from about 1 minute to 1 hour.

6. The method of claim 1 wherein step (g) comprises holding at room temperature for not more than 6 hours.

7. The method of claim 1 wherein step (h) comprises reheating to a temperature ranging from about 190° to 210° F. for a time period ranging from about 1.5 to ½ hours.

8. The method of claim 1 wherein the aluminum alloy comprises about 1.0 to 1.3 wt.% silicon.

9. The method of claim 1 wherein the aluminum alloy comprises about 0.40 to 0.80 wt.% magnesium.

10. The method of claim 1 wherein the aluminum alloy comprises about 0.02 to 0.20 wt.% chromium.

11. The method of claim 1 wherein the aluminum alloy comprises about 0.2 to 0.20 wt.% manganese.

12. The method of claim 1 further comprising homogenizing the alloy at a temperature ranging from about 800° to 1100° F. for about 1 to 24 hours after step (a) and before step(b).

13. The method of claim 12 wherein step (b) comprises hot rolling to obtain a gauge thickness ranging from about 0.02 to 0.10 inches.

14. The method of claim 13 further comprising cold working after step (b).

15. A method of producing an aluminum article comprising the steps of:

(a) providing stock including an aluminum alloy comprising about 0.40 to 1.50 wt.% silicon, about 0.20 to 1.50 wt.% magnesium, about 0.02 to 0.20 wt.% of an element selected from the group consisting of manganese and chromium, not more than about 0.70 wt.% copper, the remainder substantially aluminum, incidental elements and impurities;

(b) strip casting the stock;

(c) cold rolling;

(d) solution heat treating at a temperature ranging from about 900° to 1100° F. for a time period of about 2.0 seconds to about 30 minutes;

(e) rapid quenching at a rate of at least about 200° F./second to a threshold temperature ranging from about 150° to 250° F. and holding at the threshold temperature for at least 30 seconds.

(f) cooling to room temperature at a rate of at least about 1.8° F./minute;

(g) holding at room temperature for not more than 24 hours; and (h) reheating to a temperature ranging from about 150° to 360° F. for a time period of about 24 hours to 2.0 minutes.

16. A method of producing an aluminum article comprising the steps of:

(a) providing stock including an aluminum alloy comprising about 1.0 to 1.3 wt.% silicon, about 0.40 to 0.80 wt.% magnesium, about 0.02 to 0.20 wt.% of an element selected from the group consisting of manganese and chromium, not more than about 0.70 wt.% copper, the remainder substantially aluminum, incidental elements and impurities;

(b) hot rolling the stock at a temperature ranging from about 980° to 1025° F. to obtain a gauge thickness ranging from about 0.20 to 0.10 inches;

(c) solution heat treating at a temperature ranging from about 1000° to 1030° F. for a time period of about 3 to 10 minutes;

(d) rapid quenching at a rate of about 500° F./second to a threshold temperature of about 200° F., and holding for a time period ranging from about 2 to 10 minutes;

(e) cooling to room temperature at a rate above 1.8° F./second;

(f) holding at room temperature for not more than 6 hours; and (g) reheating to a temperature of about 200° F. for a time period of about an hour.

* * * * *